US005303773A

United States Patent [19]

Czernichow et al.

[11] Patent Number: 5,303,773

[45] Date of Patent: Apr. 19, 1994

[54] DEVICE FOR MONITORING A DEPOSIT FOR A PRODUCTION WELL

[75] Inventors: Jean Czernichow, Chatenay Malabry; Jean Laurent, Orgeval, both of France

[73] Assignee: Institut Francais Du Petrole, Rueil-Malmaison, France

[21] Appl. No.: 945,889

[22] Filed: Sep. 17, 1992

[30] Foreign Application Priority Data

Sep. 17, 1991 [FR] France ..... 91 11536

[51] Int. Cl.[5] ..... E21B 47/00

[52] U.S. Cl. ..... 166/66; 166/242; 166/250

[58] Field of Search ..... 166/242, 66, 250, 65.1

[56] References Cited

U.S. PATENT DOCUMENTS

| | | | |
|---|---|---|---|
| 4,392,376 | 7/1983 | Lagus et al. | 73/155 |
| 4,475,591 | 10/1984 | Cooke, Jr. | 166/66 X |
| 4,570,481 | 2/1986 | McLaurin | 73/152 |
| 4,593,771 | 6/1986 | Comeau | 166/242 X |
| 4,628,995 | 12/1986 | Young et al. | 166/242 X |
| 4,711,123 | 12/1987 | Christensen | 166/242 X |
| 4,775,009 | 10/1988 | Wittrisch et al. | 166/250 |
| 4,979,563 | 12/1990 | Patel | 166/250 |

FOREIGN PATENT DOCUMENTS

| | | |
|---|---|---|
| 2168920 | 9/1973 | France . |
| 2642849 | 2/1989 | France . |
| 2196410 | 4/1988 | United Kingdom . |

*Primary Examiner*—Hoang C. Dang

*Attorney, Agent, or Firm*—Antonelli, Terry, Stout & Kraus

[57] ABSTRACT

A casing is lowered in a well for production of an underground petroleum deposit. The casing includes a number of tubular sections connected successively to each other by special tubular connectors, at least certain of these being modified, and the casing being cemented in position when installed in the well. These special connectors include housings for one or several sensors and other housings, if necessary, for the electronic acquisition or transmission circuits. The different connectors for the device are interconnected by cables and to an installation on the surface by a multi-line cable for the electrical supply to the electronic modules and transmission of the data acquired. This arrangement permits prewiring of the different connectors, thus simplifying the positioning of the device during operations for equipping the wells.

21 Claims, 2 Drawing Sheets

DEVICE FOR MONITORING A DEPOSIT FOR A PRODUCTION WELL

Figure 1:
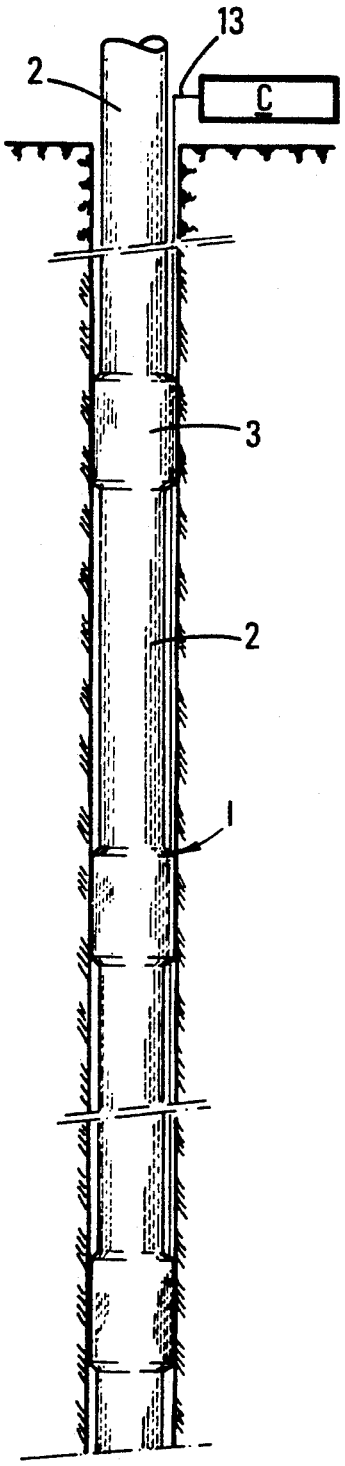

The invention concerns an improved device for monitoring an underground deposit and which is permanently installed in a cased well.

A device of this kind is used, for example, in wells equipped for production operations for an underground deposit and, in particular, an oil bearing deposit. In applications of this kind, a monitoring device permits different types of measurements to be carried out e.g., verification of the condition of the well, monitoring of the equipment in the well, obtaining readings from the acoustic emissions produced by the zone during production operations, carrying out seismic recordings in order to determine changes over a period of time in the underground zone monitored, etc. Published French patents applications No. 2 593 292 and 2 642 849 describe methods for installing a number of sensors in a well which, because of the requirements necessary to produce petroleum fluids, is equipped with a well casing sealed in the well by cementing. The sensors are installed outside the well casing when this casing is placed in the well and they are embedded in the cement which is around the casing in order to provide a bond with the walls of the well. Patent application 2 642 849 describes a device to facilitate the installation of monitoring equipment in the well. This devices comprises protective elements fixed externally to certain sections of the well casing, thereby defining housings where it is possible to fix the receiving units. Each of these units comprises a support with cavities for the acoustic or seismic sensors and electronic circuits to amplify and correct the signals received, before their transmission by a transmission line passing along the casing up to a central control and recording station installed on the surface. The device is designed to effectively protect the monitoring equipment placed outside the well casing, against impact and compaction which generally occurs during the operations of lowering and positioning the casing in the drilled wells.

The installation, in a well, of the above device requires the use of sections of casing, modified by welding on thick ribs and anchorage elements, for the purpose of defining the housings for the units containing the sensors and the electronic equipment for acquisition and transmission of data. The addition of these protective elements must often be carried out by modifying those sections of casing available on the site of the wall and even the equipment for the well. Also, the elements fitted to the outside of the well casing result in an additional thickness and the total cross section is very considerably increased. This is very often a considerable disadvantage in relatively narrow wells.

The improved device in accordance with the present invention permits a simplified integration of the equipment for monitoring the well casings designed to be cemented in position when placed in the wells, by using elements which may be manufactured in a workshop and transported to the site of a well in order to be directly connected to the sections of well casing at the time of their assembly.

The improved device for monitoring a deposit, in accordance with the invention, is designed to be installed in a well provided with a casing comprising a number of sections interconnected by tubular connectors, this casing being maintained in place by the injection of cement into the annular space between it and the well. The device in accordance with the invention is characterised in that it comprises at least one tubular connector between two successive sections of well casing, modified to contain a principal monitoring module including sensitive sensors and an electronic unit, the said monitoring module being connected to an installation on the surface, by means of a connection.

The device may comprise, for example, at least a second tubular connector, modified and containing a secondary monitoring module including sensitive sensors and a sealed means of connection for the interconnection of each second monitoring module to the first module.

Each secondary monitoring module may comprise an electronic means of amplification and filtering of the signals received by the sensors for the same module.

The device comprises, for example, at least one secondary monitoring module connected to the principal module by a means of analog transmission.

The device may also comprise at least one secondary monitoring module provided with a means for the acquisition of signals received by the sensitive sensors for at least one other secondary monitoring module.

The electronic unit for the principal monitoring module comprises, for example, a means of digital transmission for communications between it and the said installation on the surface.

The device may also comprise at least one secondary monitoring module, including a means of digital connection with the principal monitoring module.

In accordance with a method of constructing the invention, the device comprises asymmetrical tubular connectors provided with a wall which is thicker over one part of its circumference, this thicker wall being provided with several housings for the elements comprising the monitoring module, these housings being sealed by a cover fixed against the said wall.

In accordance with a method of constructing the invention, the device comprises connecting cables located outside the well casing.

In accordance with another method of constructing the invention, the device comprises a means of connection located partly inside the different sections of well casing.

Using the device in accordance with the invention, the well casing may be installed more easily by the interconnection of sections by means of connectors pre-equipped with sensitive sensors and electronic modules, these being connected to each other, as the installation progresses, by cables which are connected by sealed connectors. The operations of equipping the wells are therefore considerably facilitated.

Figure 2:
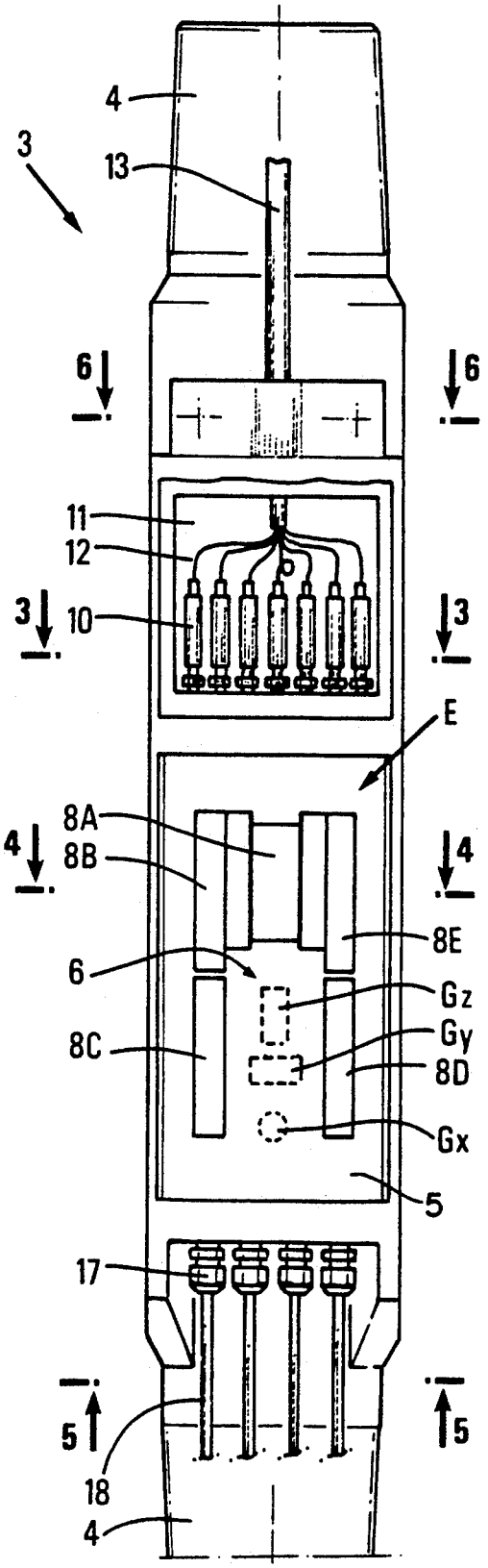
Figure 3:
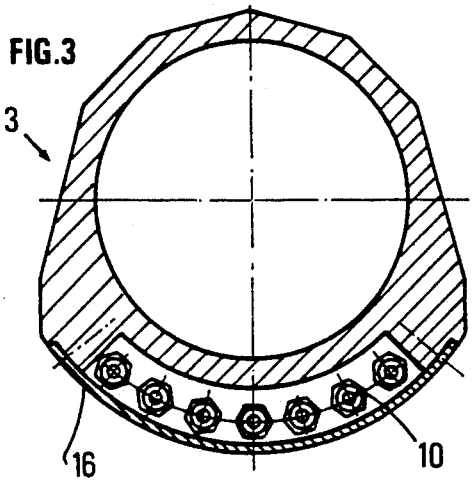
Figure 6:
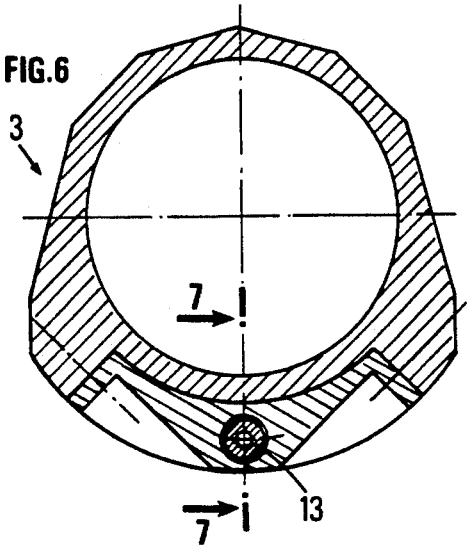
Figure 4:
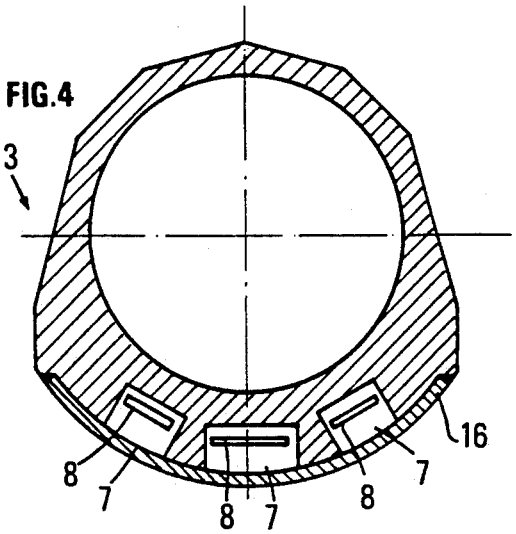
Figure 5:
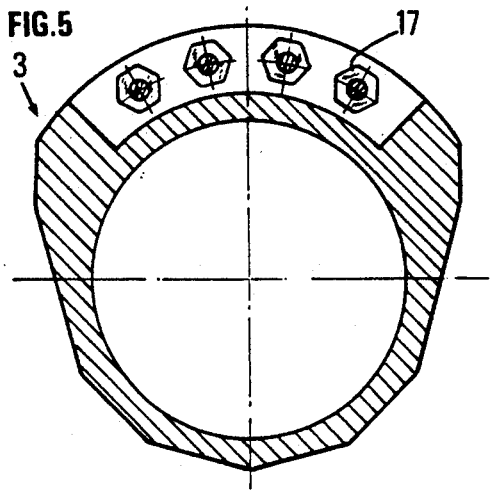
Figure 7:
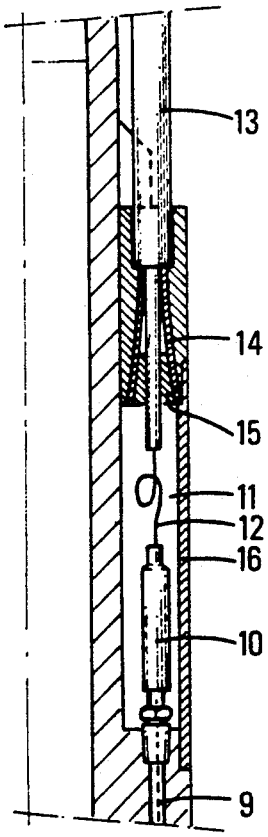

Other characteristics and advantages of the device in accordance with the invention will be more fully understood on reading the following description relating to the methods of constructing the invention and described, as non limiting examples, by referring to the appended Figures where:

FIG. 1 shows, schematically, a well casing with connectors for the interconnection of its different sections FIG. 2 shows schematically, a principal monitoring module installed in an intermediate connector FIGS. 3 to 6 show cross sections of the same connector, in accordance with several cross-sectional planes FIG. 7 shows, schematically, the connection of the conductive lines for a transmission cable located outside the well casing, together with the internal conductors for a monitoring module.

A well 1 is drilled for obtaining production from an underground deposit and a casing 2 (FIG. 1) is installed, this being formed by the interconnection, end to end, of a number of sections by means of connectors 3 and maintained in place by injecting cement in the annular space between and the well 1.

Monitoring the production zone requires the installation, in the well, of a number of sensitive sensors designed for the type of measurements to be carried out. This installation is carried out using the device in accordance with the invention, by replacing the conventional connectors used to connect the sections of the casing, by the special connectors 3 to be described relative to FIGS. 2 to 7.

The connectors 3 are tubular and offset with, at each end, an adapter 4 which receives, by threading, one end of a section of the well casing. On one part of their circumference, the connectors 3 have an increased wall thickness 4. In each of these zones of increased thickness 4, various housings 5 are provided for suitable sensor elements 6 such as, for example, three geophones Gx, Gy, Gz, axes thereof being orientated in accordance with three orthogonal directions, in order to determine the amplitude and the direction of arrival of the waves received. Other housings 7 are provided for an electronic unit E. Depending on circumstances, the electronic unit may comprise one or more circuits or cards 8 designed to process the signals received by the different sensors 6. Electrical conductors 9 (FIG. 7), associated with the different sensors 6 and/or the cards 8, are connected by sealed connectors 10, in a lateral cavity 11 in the upper part of the connectors 3, with the various conductive lines 12 of a multi conductor cable 13. The cable 13 passes through an end wall of the connector 3 (FIG. 7) and emerges in the lateral cavity 11. Its outer sheath 14 is maintained in place relative to this by means of a locking taper 15. When the connections are established between the lines 12 and the sealed connectors 10, the cavity 11 is filled with an insulating grease and closed by an external plate 16. The cable 13 is placed, for example, outside the well casing and extends up to a central control and recording station C on the surface (FIG. 1).

In the lower part of each connector 3, sealed connectors 17 provide a connection to the electronic unit, for several external cables 18.

This type of tubular connector 3 permits different arrangements of the monitoring device. In accordance with the invention, this comprises at least one principal module connector 3, such as that shown in FIGS. 2 to 7. This principal module comprises an electrical supply circuit 8A supplied from the surface installation C by the conductors 12 of the multi conductor cable 13 and produces the regulated voltages necessary for operating at least the principal module, several acquisition circuits 8B, 8C, 8D, designed to amplify, filter, digitalise and, if necessary, multiplex the signals received by the sensors, together with a coding circuit 8E for transmission of the signals acquired to the central station C on the surface.

The monitoring device in accordance with the invention may also comprise at least one secondary module in another connector, at a different depth, with housings for at least one or several sensors 6. These sensors may be connected directly by the cables 18 to the principal module and the signals which they receive are acquired by its electronic circuits.

In accordance with another method of constructing the invention, the secondary module may also comprise local electronic circuits for amplification and filtering of the signals received locally, before their transmission in analog form to the principal module.

In accordance with another arrangement comprising two stages, a secondary module, not provided with electronic circuits, may directly transmit the analog signals produced by the local sensors to a secondary relay module which includes amplification and filtering circuits and this relay module transmits all the signals amplified to a principal module by means of an analog or digital type connection.

The monitoring device may comprise a considerable number of different sensors distributed within a number of connectors at different depths on the well casing, together with secondary modules, without electronic circuits, one or several secondary relay modules provided with electronic circuits to collect the signals received at one or more lower levels and transmit these, when amplified, to a principal module provided with circuits for coding, multiplexing and the transmission of data collected, towards the central station C on the surface.

The passive elements (sensors) and the active elements (electronic circuits) are assembled in the connections and prewired and installation of the device at the time of constructing the well casing 2 basically consists of establishing the electrical connections for the cables 13 and 18 which connect all these to the surface installation.

In accordance with the described method of constructing the invention, the cables 1 3 p 18, for the interconnection of the different monitoring modules and the connection of a principal module are located outside the well casing. However, the scope of the invention is not exceeded by providing connections which are at least partly included inside the well casing.

We claim:

1. A device adapted to be installed in a well for monitoring an underground deposit, said device comprising a casing having a plurality of tubular sections and a plurality of tubular connectors for interconnected the tubular sections, said casing being maintained in place in the well by injection of cement into the annular space between the casing and the well, at least one tubular connector being positioned between two successive tubular sections of the well casing, said at least one tubular connector comprising at least one sealed housing containing a principal monitoring module including sensitive sensors, and means for connecting said principal monitoring module to a central control and recording station on the surface.

2. A device according to claim 1, further comprising at least a secondary tubular connector having a sealed housing containing at least one secondary monitoring module including sensitive sensors and a sealed connection means for effecting interconnection of the at least one secondary monitoring module to the principal monitoring module.

3. A device according to claim 2, wherein the principal monitoring module and each secondary monitoring module comprise an electronic means for effecting amplification and filtering of the signals received by the sensors of each respective module.

4. A device according to claim 2 or claim 3, wherein said sealed connection means include an analog transmission means for connecting the at least one secondary monitoring module to the principal module.

5. A device according to claim 2 or claim 3, further comprising at least one secondary relay module provided with means for acquisition of signals received by the sensitive sensors included in the at least one secondary monitoring module.

6. A device according to claim 2, wherein the principal monitoring module has an electronic unit comprising means for effecting digital transmission of communications between the principal module and said control and recording station on the surface.

7. A device according to claim 6, wherein the at least one secondary monitoring module comprises digital connecting means for connecting the principal monitoring module with the at least one secondary monitoring module.

8. A device according to claim 1, wherein each tubular connector has an asymmetrical shape and comprises a wall which is thicker over one portion of the circumference of the wall, said thicker wall portion defining several housings for receiving said monitoring modules, said housings being sealed by a cover fixed to said thicker wall portion.

9. A device according to claim 1, wherein said means for connecting said principal module to the control and recording station on the surface comprises connecting cables located outside the well casing.

10. A device according to claim 1, wherein said means for connecting said principal module to the central and recording station comprises means located at least partly inside the tubular connectors of the well casing.

11. A device adapted to be installed in a wall for monitoring an underground deposit, said device comprising a tubular casing comprising a number of tubular sections interconnected end to end by tubular connectors positioned between any two successive tubular sections, said casing being held in position within the well by injecting cement into an annular space between said casing in the well, at least one of said tubular connectors interconnecting two successive casing sections defining at least one sealed cavity, a main monitoring module including sensors positioned in said at least one sealed cavity, and cable means for connecting said main monitoring module with a central control and recording station on the surface.

12. A device according to claim 11, further comprising at least one other tubular connector defining another sealed cavity and at least one secondary monitoring module including sensors positioned within said another sealed cavity, and a sealed cable means for interconnecting said at least one secondary monitoring module to the main monitoring module.

13. A device according to claim 12, wherein said main monitoring module and said at least one secondary monitoring module each comprise amplifying and filtering means for signals received by said sensors in each respective monitoring module.

14. A device according to claim 12, wherein said sealed cable means includes an analog transmission means.

15. A device according to claim 13, wherein said sealed cable means includes an analog transmission means.

16. A device according to claim 12, wherein said at least one secondary monitoring module includes an acquisition means for acquiring signals from sensors included in the at least one secondary monitoring module.

17. A device according to claim 11, wherein said main monitoring module includes a digital transmission means for transmitting information between the main monitoring module and said control and recording station.

18. A device according to claim 16, wherein said at least one secondary monitoring module includes a digital transmitting means for transmitting data to said main monitoring module.

19. A device according to claim 11, wherein each tubular connector has an asymmetrical shape and an external wall with a portion that is thicker over one part of the circumference of the wall, said thicker wall portion defining several cavities for receiving said monitoring modules, a cover for sealing said cavities and a sealed connection means for fixing said cover to said wall portion, thereby forming a plurality of sealed cavities.

20. A device according to claim 11, wherein said cable means are located outside the well casing.

21. A device according to claim 11, wherein said cable means includes connection means located at least partly inside the tubular connections of the wall casing.

* * * * *